US006370826B2

(12) United States Patent
Barry et al.

(10) Patent No.: US 6,370,826 B2
(45) Date of Patent: Apr. 16, 2002

(54) ARCUATE FACIA

(76) Inventors: Michael A. Barry, 5921 Franmar Cir., Huntington Beach, CA (US) 92649; George E. Goodwin, 1670 W. Broadway, No. 17B, Anaheim, CA (US) 92802

( * ) Notice: Subject to any disclaimer, the term of this patent is extended or adjusted under 35 U.S.C. 154(b) by 0 days.

(21) Appl. No.: 09/827,137

(22) Filed: Apr. 5, 2001

Related U.S. Application Data

(63) Continuation of application No. 09/311,099, filed on May 13, 1999, now abandoned.

(51) Int. Cl.[7] ..... E04B 7/00

(52) U.S. Cl. ..... 52/82; 52/80.1; 52/92.1; 52/93.2; 52/94; 52/745.07; 52/745.08

(58) Field of Search ..... 52/80.1, 92.1, 52/92.3, 93.2, 94, 74, 77, 82, 245, 639, 745.07, 745.08

(56) References Cited

U.S. PATENT DOCUMENTS

| | | | |
|---|---|---|---|
| 323,110 | A | 7/1885 | Carlewitz |
| 468,354 | A | 2/1892 | Mayhew |
| 604,277 | A | 4/1898 | Tofft |
| 1,096,944 | A | 5/1914 | Phillips |
| 1,128,576 | A | 2/1915 | Blair |
| 1,223,266 | A | 4/1917 | Dyer |
| 1,267,084 | A | 5/1918 | Knox |
| 1,762,363 | A | 6/1930 | Sergent |
| 1,938,024 | A | 12/1933 | Keeffe |
| 2,011,796 | A | 8/1935 | Christensen |
| 2,292,078 | A | 8/1942 | Inman et al. |
| 2,335,708 | A | 11/1943 | Strobel |
| 2,342,916 | A | 2/1944 | Blaski |
| 2,463,834 | A | 3/1949 | Von Brenton |
| 2,736,397 | A | 2/1956 | Colby, Jr. |
| 2,988,810 | A | 6/1961 | Wilken |
| 3,009,211 | A | 11/1961 | Hansen et al. |
| 3,034,824 | A | 5/1962 | Schuback |
| 3,130,488 | A | 4/1964 | Lindstrom |
| 3,168,815 | A | 2/1965 | Blenkle et al. |
| 3,364,634 | A | 1/1968 | Allaire |
| 3,440,790 | A | 4/1969 | Nerem |
| 3,508,370 | A | 4/1970 | Riblet |
| 3,546,826 | A | 12/1970 | Chapman |
| 3,763,618 | A | 10/1973 | Bennett et al. |
| 3,924,367 | A | 12/1975 | Stewart |
| 4,094,110 | A | 6/1978 | Dickens et al. |
| 4,241,555 | A | 12/1980 | Dickens et al. |
| 4,284,447 | A | 8/1981 | Dickens et al. |

(List continued on next page.)

FOREIGN PATENT DOCUMENTS

| | | |
|---|---|---|
| BE | 533433 | 12/1954 |
| FR | 1489329 | 4/1967 |
| GB | 20684 | of 1906 |
| GB | 540881 | 11/1941 |
| GB | 1059397 | 6/1964 |
| IT | 535641 | 11/1955 |

*Primary Examiner*—Carl D. Friedman
*Assistant Examiner*—Brian E. Glessner
(74) *Attorney, Agent, or Firm*—Stetina Brunda Garred & Brucker

(57) ABSTRACT

In an arcuate roof section including a series of rafters which each define an exposed end of the prescribed height, a device positionable along the exposed ends of the series of rafters to define an arcuate facia. The device comprises at least one facia member having an arcuate inner surface, an arcuate outer surface, a top edge and a bottom edge. The inner surface of the facia member is configured to abut the exposed ends of the rafters such that the outer surface defines the arcuate facia. Additionally, the width between the top edge and the bottom edge of the facia member exceeds the height of the exposed ends. The facia member may be formed from a plurality of laminated wood members or formed from bonded particulate matter. Additionally, the facia member may be formed from a plastic material.

5 Claims, 1 Drawing Sheet

U.S. PATENT DOCUMENTS

| | | | |
|---|---|---|---|
| 4,301,632 | A | 11/1981 | Wanger |
| 4,557,090 | A | 12/1985 | Keller, Sr. |
| 4,601,138 | A | 7/1986 | Hampton |
| 4,642,955 | A | 2/1987 | Webb |
| 4,780,998 | A | 11/1988 | Knapp |
| 4,785,605 | A | 11/1988 | Jenn |
| 4,873,796 | A | 10/1989 | Akmese |
| 4,955,168 | A | 9/1990 | Barry |
| 5,067,288 | A | 11/1991 | Takahama et al. |
| 5,130,915 | A | 7/1992 | Lerch |
| 5,341,610 | A | 8/1994 | Moss |
| 5,459,974 | A | 10/1995 | Barry et al. |
| 5,522,186 | A | 6/1996 | Jarman |
| 5,584,148 | A | 12/1996 | Barry et al. |
| 5,649,393 | A | 7/1997 | Barry et al. |
| 5,815,990 | A | 10/1998 | Barry et al. |
| 6,094,877 | A | 8/2000 | White |

ARCUATE FACIA

CROSS-REFERENCE TO RELATED APPLICATIONS

This application is a continuation of application Ser. No. 09/311,099, filed on May 13, 1999, now abandoned.

BACKGROUND OF THE INVENTION

The present invention generally relates to the art of building construction and more particularly to a device that forms an arcuate facia for a structure.

The installation of a straight facia around a roof or deck typically comprises nailing an elongate board across the exposed ends of the rafters. The rafters, which protrude down from the sloped section of the roof, are supported by the outside wall of the structure such that the rafters and roofing material attached thereon form the eaves of the structure. Typically, the facia is placed over the exposed ends of the rafters to form a horizontal covering such that the ends of the rafters are not visible. Additionally, a facia may also be used to cover the exposed ends of ceiling joists that protrude from a deck or flat roof. After installation, the facia may be painted or covered with material depending upon the application.

However, the above-described installation process is not adequate for installation of a facia around a curved roof or deck. In such a situation, the rafters or joists are configured to create a curved roof. Therefore the exposed ends of the rafters or joists define a curved area that is to be covered. Specifically, the exposed ends of the rafters or joists define a radius of curvature in such a manner that a facia having the same radius of curvature may be used to cover the exposed ends thereof.

In order to cover the exposed ends of the rafters or joists, typically a straight facia is curved around such ends by lapping sections of wood together. The wood sections are attached together such that a curved facia is formed from the multiple sections of wood. This process can be very time consuming and labor intensive and may result in an uneven finish from the joints between the sections of wood not being smooth. Alternatively, a curved facia may be created by cutting vertical serrations in the outer surface of a straight facia board thereby allowing the board to be curved horizontally around the rafter ends. The vertical serrations, however, must be filled after affixing the board to the rafters in order to provide a smooth outer surface for painting and/or other types of covering. Additionally, if the area spanning the rafter ends is quite large, then the boards must be attached to one another in an end-to-end fashion that collectively defines the curved facia. Therefore, this technique is labor intensive as well as time consuming since the facia will need to be properly prepared after attachment to the structure in order to provide a proper finish surface.

The above-described methods of installing a curved facia can result in non-uniform and sometimes uneven finish surfaces. As a result, such defects are readily visually apparent and detract from the overall appearance of the structure. Additionally, remedial work may be required by the builder in order to correct such defects in appearance which may also be time consuming. The present invention corrects such deficiencies in the prior art curved facias by providing a curved facia that is uniformly smooth and easy to install. As such, the present invention is intended to provide a simple and inexpensive arcuate facia that can be used for curved roofs and decks.

BRIEF SUMMARY OF THE INVENTION

In accordance with the preferred embodiment of the present invention, there is provided for an arcuate roof section including a series of rafters which each define an exposed end of a prescribed height, a pre-formed device positionable along the exposed ends of a series of rafters to define an arcuate facia. The device comprises at least one facia member having an arcuate inner surface, an arcuate outer surface, a top edge and a bottom edge. The inner surface of the facia member is configured to abut the exposed ends of the rafters such that the outer surface defines the arcuate facia. The width of the facia member between the top edge and the bottom edge exceeds the height of the exposed ends of the rafters such that the device fully covers the exposed ends.

The facia member may be formed from a plurality of laminated wood members. Additionally, the member may be formed of bonded particulate matter such as cellulose fiber, shredded paper, wooden particles, sawdust or any possible combination thereof. Furthermore, the device may be fabricated from a plastic material bonded into the necessary shape. The facia member may additionally comprise a series of arcuate facia segments attached to the exposed ends in end-to-end fashion. The arcuate facia member may also be adapted to cover the exposed ends of a series of joists.

In accordance with the present invention, there is also provided an arcuate facia covering structure. The structure comprises a first rafter having a first exposed end of a prescribed height and a second rafter having a second exposed end of a prescribed height and in spaced relation to the first rafter. Furthermore, the structure includes at least one facia member having an arcuate inner surface, an arcuate outer surface, a top edge and a bottom edge. The inner surface of the facia member is configured to abut the exposed ends of the rafters such that the outer surface defines an arcuate facia. Furthermore, the width between the top edge and the bottom edge of the facia member exceeds the height of the rafters' exposed ends.

The present invention further provides for a method of covering a series of rafters which each define an exposed end of a prescribed height with an arcuate facia. The method comprises providing at least one facia member having an arcuate inner surface, an arcuate outer surface, a top edge and a bottom edge wherein the width between the top edge and the bottom edge exceeds the height of the exposed ends. Next, the facia member is attached to the exposed ends of the rafters such that the outer surface defines an arcuate facia. Furthermore, it is contemplated that the inner surface of the facia member may be abutted against the exposed ends of the rafters. The method can further comprise providing a series of arcuate facia segments and attaching the facia segments in an end-to-end fashion to collectively define the facia member.

BRIEF DESCRIPTION OF THE DRAWINGS

These as well as other features of the present invention, will become more apparent upon reference to the drawings wherein.

DETAILED DESCRIPTION OF THE INVENTION

Figure 1:
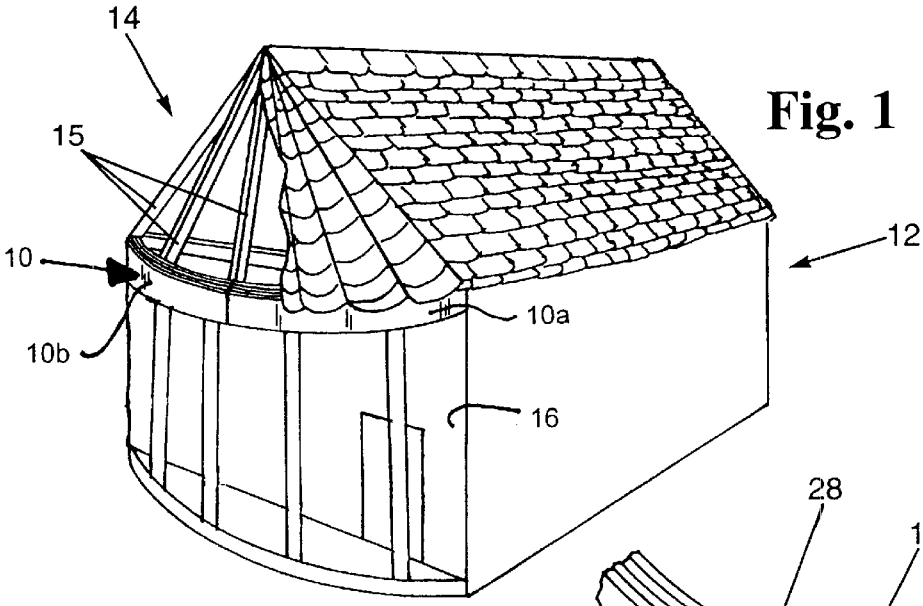
FIG. 1 is a perspective view of a structure having an arcuate facia constructed in accordance with the preferred embodiment of the present invention attached thereto.
Figure 3:
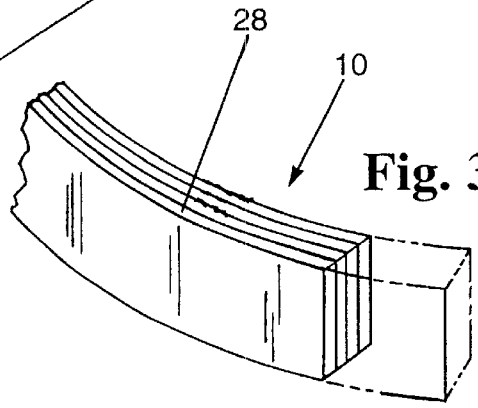
FIG. 3 is a partial perspective view of the arcuate facia shown in FIG. 2.
Figure 4:
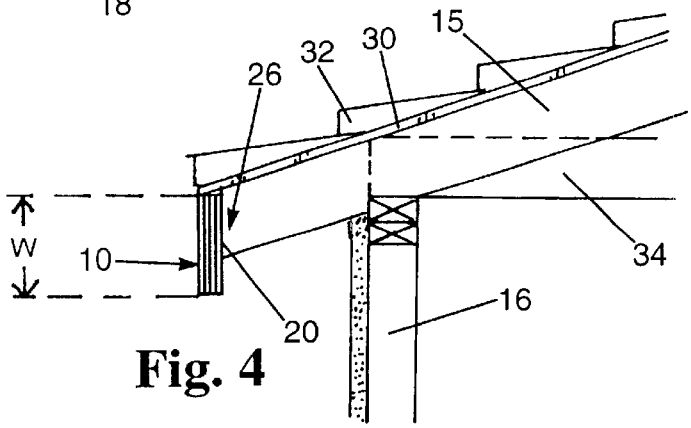
FIG. 4 is a cross-sectional view of the structure and arcuate facia shown in FIG. 1.

Referring now to the drawings wherein the showings are for purposes of illustrating a preferred embodiment of the present invention only, and not for purposes of limiting the same, FIG. 1 perspectively illustrates an arcuate facia 10 attached to a structure 12. The arcuate facia 10 is positioned adjacent to the bottom of a curved roof portion 14 such that the outer, exposed ends 26 of the roof members (e.g., rafters 15) which extend from the structure 12 are covered thereby as seen in FIG. 4. The curved roof portion 14 is defined by a series of rafters 15 that extend from the apex of the roof portion 14 and are supported above an exterior wall 16. Therefore, the exposed ends of the rafters 15 collectively define a radius of curvature $R_r$ around the bottom of roof portion 14.

Figure 2:
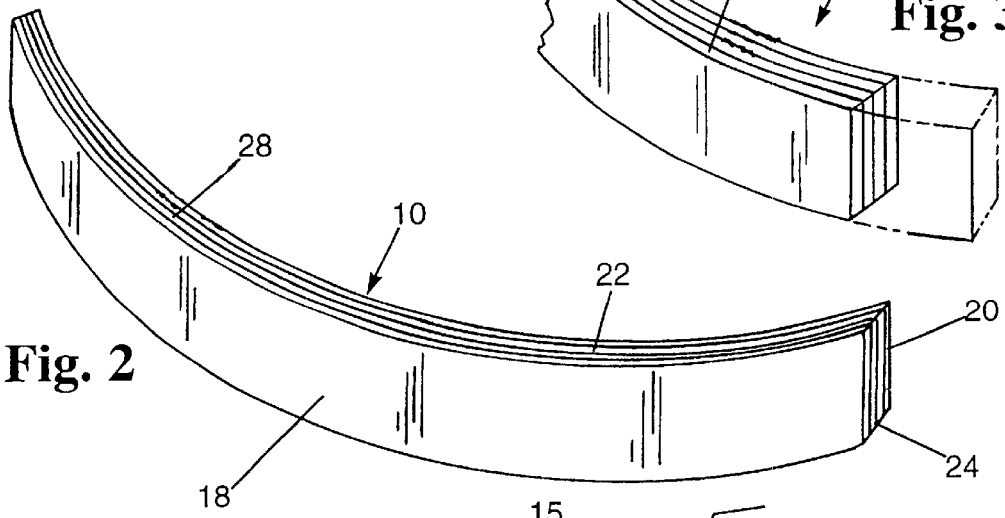
FIG. 2 is a perspective view of the arcuate facia shown in FIG. 1.

The arcuate facia 10 constructed in accordance with the preferred embodiment is pre-formed into the proper shape before attachment to the structure 12. As seen in FIG. 2, the facia 10 has an arcuate outer surface 18, an arcuate inner surface 20, a top edge 22 and a bottom edge 24. As will be further explained below, the facia 10 is formed such that the inner surface 20 has an inner-surface radius of curvature that is approximately equal to the rafter radius of curvature collectively defined by the exposed ends 26 of rafters 15 that extend from curved roof portion 14. Referring to FIG. 4, the inner surface 20 of facia 10 is configured to be in abutting contact with the exposed end 26 of each rafter 15 that collectively defines the rafter radius of curvature. Additionally, the width W of the facia 10 between the top edge 22 and the bottom edge 24 is greater than the height of the exposed end 26 such that the facia 10 can completely cover end 26.

As best seen in FIG. 2, the facia 10 is preferably formed by the laminar juxtaposition of multiple wood laminate layers 28 which are fused together to form a unitary laminated structure. The individual laminate layers 28 are typically formed around an arcuate jig structure with glue or other binding agent disposed between each layer 28. Typically, the radius of curvature of the arcuate jig is approximately equal to the rafter radius of curvature collectively defined by the exposed ends 26 of the series of rafters 15. Alternatively, the facia 10 may be formed from bonded particulate matter including cellulose fiber, shredded paper, wooden particles, sawdust and possible combinations thereof. A quantity of these wooden or paper particles are typically placed into an arcuate or circular mold along with various binding agents or other chemicals capable of resulting in a composite structure of sufficient integrity to serve as an arcuate facia 10. As will be recognized, when a circular mold or mandrel is used to form an arcuate facia 10, the resulting circular laminated or molded member may be cut to form multiple arcuate members. Additionally, the arcuate facia 10 may be formed from plastic molded into the preferred shape having the preferred curvature.

The outer surface 18 of facia 10 typically has the same radius of curvature as the inner surface 20. In order to achieve a proper appearance, the outer surface 18 may be formed from a layer 28 that has a press board pattern formed thereon. Alternatively, the outer surface 18 may be formed from a layer 28 that has a re-sawn or a rough lumber pattern formed thereon depending upon the application. If the facia 10 is to be painted, then the outer surface 18 is formed from a paint grade layer 28 of wood. However, if the facia 10 is to be covered with stucco or another type of building material, then the layer 28 used for outside surface 18 can be less than paint grade. Additionally, the outer surface 18 may be formed from a layer 28 that is embossed with a decorative pattern.

As seen in FIG. 1, the facia 10 covers the exposed ends 26 of rafters 15 that form the curved roof portion 14. Therefore, the facia 10 will have a longitudinal length that corresponds to the total distance between the series of rafters 15. Therefore, in order to span the complete distance of the curved roof portion 14, the facia 10 may be fabricated from multiple sections that are abutted in end-to-end fashion. As seen in FIG. 1, the arcuate facia 10 may comprise two arcuate facia segments 10*a* and 10*b* attached to one another in end-to-end fashion and attached to the exposed ends 26 of the rafters 15.

Referring to FIG. 4, the inner surface 20 of the facia 10 abuts the exposed end 26 of each rafter 15. Typically, the end 26 of rafter 15 is cut generally vertically such that end 26 is parallel to exterior wall 16. The facia 10 is attached to the end 26 of each rafter 15 with a nail or other similar type fastener. A layer of plywood sheathing 30 is applied to the top of rafters 15 and then a layer of roofing material 32 is applied over the sheathing 30. The roofing material 32 may be shakes, shingles or tiles as is commonly found in the building industry. Additionally, roofing felt or other type of moisture proof barrier may be applied between the plywood sheathing 30 and the roofing material 32. As seen in FIG. 4, the plywood sheathing 30 and roofing material 32 may extend over the top edge 22 of facia 10 in order to provide a drip edge for moisture draining off curved roof portion 14. Furthermore, as seen in FIG. 4, a horizontal rafter 34 is disposed adjacent to the rafter 15. The rafter 34 is generally horizontal and extends between walls 16 of the structure 12.

In addition to being configured for use on inclined roof rafters 15, the facia 10 may be attached to horizontal rafters 34 as encountered on flat roof applications. As shown, a series of horizontal rafters 34 extend out from the wall 16. In such instances, the plywood sheathing 30 and roofing material 32 are supported by the rafters 34. The rafters 34 extend over the wall 16 such that the end of the rafters 34 is exposed. The ends of rafters 34 will define an arc that facia 10 may be nailed onto. As with the rafters 15, the inner surface 20 of facia 10 will abut and cover the exposed end of each horizontal rafter 34. The facia 10 is formed as previously described and instead of it being attached to a rafter 15, facia 10 will be attached to the end of the horizontal rafters 34.

Additional modifications and improvements of the present invention may also be apparent to those of ordinary skill in the art. Thus, the particular combination of parts described and illustrated herein is intended to represent only a certain embodiment of the present invention, and is not intended to serve as limitations of alternative devices within the spirit and scope of the invention.

What is claimed is:

1. A roof assembly comprising:

a) an arcuate roof section comprising a series of planar rafters wherein each rafter defines an exposed end of a prescribed height and wherein each rafter emanates angularly downwardly from an upper central apex; and b) a visible, non-load bearing, arcuate facia member positioned along the exposed ends of the rafters, said arcuate facia comprising at least one facia member having an arcuate inner surface abutting the exposed ends of the rafters, an arcuate outer surface, a top edge, a bottom edge, and a height exceeding the prescribed height of the rafters.

2. A roof assembly as claimed in claim 1 wherein the facia member is formed from a plurality of laminated wood members.

3. A roof assembly as claimed in claim 1 wherein the facia member is formed of bonded particulate matter selected from the group consisting of:

cellulose fiber;

shredded paper;

wooden particles;

sawdust; and combinations thereof.

4. A roof assembly as claimed in claim 1 wherein the facia member is formed of a plastic material.

5. A method of forming a roof assembly, the method comprising:

a) providing an arcuate roof section comprising a series of planar rafters wherein each rafter defines an exposed end of a prescribed height and wherein each rafter emanates angularly downwardly from an upper central apex; and b) positioning a visible, non-load bearing, arcuate facia member along the exposed ends of the rafters, said arcuate facia comprising at least one facia member having an arcuate inner surface abutting the exposed ends of the rafters, an arcuate outer surface, a top edge, a bottom edge, and a height exceeding the prescribed height of the rafters.

* * * * *